US006971928B2

(12) United States Patent
Shindo et al.

(10) Patent No.: US 6,971,928 B2
(45) Date of Patent: Dec. 6, 2005

(54) CONTACT AND CONNECTOR UTILIZING THE SAME

(75) Inventors: Satoru Shindo, Aichi (JP); Akira Goto, Aichi (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/975,998

(22) Filed: Oct. 29, 2004

(65) Prior Publication Data

US 2005/0118892 A1 Jun. 2, 2005

(30) Foreign Application Priority Data

Oct. 30, 2003 (JP) ..... 2003-370963

(51) Int. Cl.[7] ..... H01R 13/11

(52) U.S. Cl. ..... 439/857; 439/884

(58) Field of Search ..... 439/851–857, 439/884

(56) References Cited

U.S. PATENT DOCUMENTS

| | | | | |
|---|---|---|---|---|
| 4,317,608 A | * | 3/1982 | Dechelette | 439/403 |
| 5,664,974 A | * | 9/1997 | Endo et al. | 439/884 |
| 5,975,964 A | * | 11/1999 | Seko et al. | 439/857 |

FOREIGN PATENT DOCUMENTS

| | | |
|---|---|---|
| JP | 2001-068184 | 3/2001 |
| JP | 2001-085090 | 3/2001 |
| JP | 2001-126791 | 5/2001 |
| JP | 2001-160458 | 6/2001 |
| JP | 2001-250612 | 9/2001 |
| JP | 2001-250648 | 9/2001 |
| JP | 2002-100440 | 4/2002 |
| JP | 2002-231343 | 8/2002 |
| JP | 2002-367697 | 12/2002 |
| JP | 2003-208952 | 7/2003 |

* cited by examiner

*Primary Examiner*—Truc Nguyen
(74) *Attorney, Agent, or Firm*—Rader, Fishman & Grauer PLLC

(57) ABSTRACT

An object of the present invention is to further reduce the height and the size of a contact to be fitted to an opposite contact for establishing electrical connection, thereby reducing the thickness and the size of a connector utilizing the same, and an opposite connector to be mounted to the connector. A contact (male contact) (1) is disposed so that a pair of band-shaped extending sections (11, 15) are overlapped with each other, and a resilient contact section which comes into abutment with an inner wall of a receiving section by a resilient force of the pair of extending sections for establishing electrical connection when being fitted in a receiving section (101) of an opposite contact (female contact) (100).

16 Claims, 7 Drawing Sheets

CONTACT AND CONNECTOR UTILIZING THE SAME

CROSS-REFERENCE TO RELATED APPLICATIONS

This application is based upon and claims the benefits of priority from Japanese Patent Application No.2003-370963 filed on Oct. 30, 2003, the entire contents of which are incorporated herein by reference.

FIELD OF THE INVENTION

The present invention relates to a contact and a connector utilizing the same. More specifically, the present invention relates to a contact to be fitted and electrically connected to an opposite contact and a connector utilizing the same.

RELATED ART

In order to achieve an electrical connection in an electronic equipment or the like, a contact (male contact) used for a printed board, a connector, and the like generally has a contact section of a linear rod-shape (so called pin contact) or a plate shape (so called male blade). The opposite contact (female contact) that receives the contact section has a square rod shaped or cylindrical receiving section, and in this receiving section, for example, a bellows type resilient contact strip is provided. Then, the resilient contact strip of the opposite contact comes into resilient contact with the contact section of the contact so as to ensure establishment mutual electrical connection. In other words, generally, the resilient contact strip is used on the female contact side, which corresponds to the opposite contact, and the male contact is provided with a fixed contact section which does not have a resilient contact strip.

However, when the resilient contact strip is provided on the contact, the size of the receiving section for storing the resilient contact strip increases, and hence it cannot corresponds to the recent brilliant progress of downsizing in electronic equipment or electronic parts. Also, the connector having the contact with such a resilient contact strip results in increase in mounting height of the connector housing, whereby it does not comply with reduction in height of the connector.

Therefore, an electric connector which realizes reduction in height thereof in the direction of displacement of the contact and provides a suitable contact pressure, and an electric connector having the same mounted thereon are disclosed (for example, see JP-A-2002-367697). The contact according to the JP-A-2002-367697 is provided with a substantially band-shaped resilient contact strip having a terminal section at one end and a contact point at the other end, and a substantially band-shaped abutment preventing strip having a fixed portion at one end, an abutment preventing section at the other end, and a storage hole located therebetween. In this contact, a predetermined distance is established between the resilient contact strip and the abutment preventing strip, the extremity of the contact section of the resilient contact strip is disposed in substantially parallel at the position inside the abutment preventing section, and the storage hole has a size that enables part of the resilient contact strip to enter in association with the resilient deformation of the resilient contact strip. With this contact, the opposite contact to be electrically connected comes into contact with the contact section of the resilient contact strip, the resilient contact strip moves and is displaced downward, and hence part of the resilient contact strip which is continued from the contact section enters the storage hole.

However, the contact is disposed in such a manner that the resilient contact strip is overlapped with the abutment preventing strip, and the resilient contact strip is adapted to be displaced in the vertical direction by utilizing a spring resiliency. In addition, since the distal end of the abutment preventing portion of the abutment preventing strip is formed by bending into an arcuate shape, the height of the contact is larger than the thickness of the resilient contact strip and the abutment preventing strip. In other words, the height of the contact is limited by the height of the abutment preventing section being bent in the arcuate shape.

Therefore, the height of the connector that retains the contacts in the connector housing is determined corresponding to the height of the contacts and consequently, further reduction of the height of the opposite contacts which is fitted to the contacts and the height of the connector housing of the connector that retains the opposite contacts in the contact housing cannot be realized.

Therefore, the resilient contact strip and the abutment preventing strip, especially the resilient contact strip is formed into a band-shape for displacing the resilient contact strip by the spring resilient force. In other words, since the spring resilient force is reduced as the widths of the resilient contact strip and the abutment preventing strip are becoming closer to the thickness thereof, the width must be significantly larger than the thickness thereof. Therefore, when the resilient contact strip is overlapped with and the abutment preventing strip of the contact are disposed so as to be displaced in the vertical direction by utilizing the spring resilient force of the resilient contact strip, the height of the contact is defined by the width of the resilient contact strip, and hence reduction in height of the contact and reduction in thickness of the connector housing may be impaired.

SUMMARY OF THE INVENTION

In view of such circumstances of the related art, it is an object of the present invention is to further reduce the height of the contact, thereby further reducing the thickness of the connector housing.

In order to achieve the above-described object, the inventors invented a contact wherein a pair of contacts are disposed in such a manner that respective band-shaped extending sections are overlapped with each other, and a resilient contact section which comes into abutment with the inner wall of a receiving section including a opposing wall of an opposite contact by a spring resilient force when the pair of contacts are fitted into a gap formed with respect to the opposing wall, and a connector utilizing the same.

The first aspect of the present invention is a contact to be fitted to an opposite contact for establishing electrical connection, including a resilient contact section for providing contact pressure to the opposite contact, wherein the resilient contact section includes a pair of band-shaped extending sections bifurcated toward the distal end, the pair of extending sections are overlapped with each other, and the first and second contact strips at the distal ends of the pair of extending sections are disposed at a constant distance from each other.

According to the first aspect of the present invention, since the contact has the resilient contact section in which the band-shaped pair of extending sections being overlapped with each other, the width of the resilient contact section may be reduced, and ultimate reduction in height substantially to the level of the thickness of the pair of contact strips is achieved, whereby obvious reduction in size of the contact is achieved. Also, since the first and second contact strips at the distal ends of the pair of extending sections are disposed at a constant distance from each other, for example, when the pair of contact strips are fitted in the receiving section, which corresponds to the connecting section of the connector on the other side including the opposite contact, a spring resilient force which presses the inner wall surfaces of the opposing walls which constitute the receiving section can be exerted to the pair of contact strips, and hence reliable electric connection with respect to the opposite contact is ensured. Also, since reduction in height substantially to a level of the thickness of the pair of contact strips are enabled, the height of the opposite contact which is electrically connected to the contact may also be reduced.

Preferably, one of the pair of contact strips is a movable strip and the other contact strip is a fixed strip. In this arrangement, according to the contact described above, the pair of contact strips may be composed of one of the contact strip being a movable strip and the other contact strip being a fixed strip. In this case, the distal section of the resilient contact section, that is, the width of the distal section of the pair of contact strips can further be reduced, and the size of receiving section of the opposite contact (female contact) which receives the contact for establishing electrical connection may further be reduced.

Preferably, the first extending section and the second extending section are overlapped with each other, the distal section of the second extending section is formed with a stopper member projecting and bent toward the distal section of the first extending section, whereby when a force to cause the distal section of the second extending section and the distal section of the first extending section to move toward each other is exerted in a state in which the distal section of the second extending section and the distal section of the first extending section are overlapped with each other, the distal section of the first extending section comes into abutment with the stopper member. It is also possible to overlap the first extending section and the second extending section with each other and form the stopper member which is bent toward the distal section of the first extending section over the distal section of the second extending section. In this manner, with the provision of the stopper member on the distal section of the second extending section, it may be adapted in such a manner that when the force to cause the distal section of the second extending section and the distal section of the first extending section to move toward each other is exerted in a state in which the distal section of the second extending section and the distal section of the first extending section are overlapped with each other, the distal section of the first extending section comes into abutment with the stopper member. Therefore, the movement of the distal section, which corresponds to a movable end of the second extending section can be limited, and exertion of rotational stress to the distal end of the second extending section can be alleviated. In other words, since the distal portion of the second extending section can be limited so as to be displaced (moved) by a predetermined distance, and only in the widthwise direction, displacement of the distal section of the second extending section beyond the distal end of the first extending section, and impairment of a spring resilient force at the distal section of the second extending section may be prevented.

Preferably, the distal end of the second extending section extends beyond the distal end of the first extending section, and the distal section of the second extending section is formed with an abutment preventing section inclining toward the distal section of the second extending section. It is also possible to configure such that the distal end of the second extending section extends beyond the distal end of the first extending section and the distal section of the second extending section is formed with an inclined portion inclining toward the distal section of the first extending section as the abutment preventing section. With this arrangement, since the distal section of the resilient contact section is tapered in plan view, for example, when the resilient contact section, that is, the distal sections of the second extending section and the first extending section are inserted into the receiving section of the opposite contact to establish electrical connection, the distal section of the movable strip can be displaced toward the distal section of the fixed strip while causing the inclined abutment preventing section at the distal end (stopper member) of the projecting second extending section to abut against the opening edge of the receiving section of the opposite contact, so that the position of the distal section of the movable strip is corrected to a suitable position to achieve smooth insertion, thereby ensuring establishment of the electrical connection with the opposite contact.

Preferably, the second extending section is reduced in thickness of the band-shape stepwise or continuously toward the distal section thereof. Preferably, the second extending section is reduced in width of the band-shape stepwise or continuously toward the distal section. It is also possible to form the second extending section to be reduced in cross-sectional area stepwise or continuously toward the distal section thereof, or to form the second extending section to be reduced in width stepwise or continuously toward the distal section thereof. With such arrangements, strength of the second extending section can be improved so that the movable strip with superior anti-stress property is achieved. In particular, when the width of the second extending section is reduced stepwise or continuously toward the distal section to obtain the distal section smaller in width than the first extending section at the distal side, easiness or the margin of displacement of the distal section of the second extending section can be increased. In other words, by providing a portion having a reduced width at part of the second extending section, the ratio of the width of the second extending section with respect to the thickness thereof at the concerned portion can be reduced, whereby easiness and the margin of displacement of the second extending section can be increased, thereby achieving smooth insertion of the pair of contact strips of the contact into the receiving section of the opposite contact with an adequate pressing force.

A second aspect of the present invention is a connector having a contact according to the first aspect of the present invention in a connector housing. The present invention also includes a connector wherein the contact of the present invention is held in the connector housing.

Preferably, the contact is retained in such a manner that the distal end of the connecting section between the pair of contact strips projects from the side wall of the connector housing into the connector housing. In this connector, when the contact is held in such a manner that the distal section of the connecting section between the pair of contact strips projects from the side wall of the connector housing toward the inside of the connector housing, at least one of the contact strip exerts its spring resilient force (a contact force (pressing force) with respect to the inner wall surface of the receiving section of the opposite contact) about the front end of the connecting section, that is, a root section of the contact strip. In other words, when the connecting sections of the pair of contact strips in the contact are placed within the side wall of the connector housing, the pair of contact strips project from the side wall surface of the connector housing formed of synthetic resin independently, and hence the contact section with respect to the synthetic resin serves as a fixed end, and the distal end serves as a movable end. In this manner, when the roots of the pair of contact strips are embedded and held in the side wall of the connector housing, the synthetic resin which constitutes the connector housing is deteriorated by thermal cycle during use, and hence the holding force for holding the pair of contact strips is lowered. As a consequence, a spring resilient force of the pair of contact strips may be deteriorated. However, when a configuration such that part of the front portion of the connecting section of the pair of contact strips in the contact is projected into the connecting housing and the pair of contact strips are completely projected into the connector housing is employed, one of the contact strip (movable strip) is allowed to exert the spring resilient force about the connecting section or the root section thereof irrespective of the connector housing. In other words, the independent spring resilient force can be provided to the contact itself, and lowering of the spring resilient force due to deterioration of synthetic resin of the connector housing can be prevented.

As described thus far, according to the present invention, a contact, which is significantly smaller in height, or which is significantly smaller in the entire size with respect to the contact having the resilient contact sections in the related art, can be provided. When the contact described above is held in the connector housing to configure a connector, the obvious reduction in thickness of the connector housing can be achieved, and hence reduction in size of the connector is achieved.

In addition, since the reduction in size of the contact is achieved, the height or the entire size of the opposite contact that receives the contact to establish the electrical connection can be reduced, which contributes to reduction in size of the opposite connector, whereby an extremely small sized connector can be provided.

Further features of the present invention, its nature, and various advantages will be more apparent from the accompanying drawings and the following detailed description of the present invention.

BRIEF DESCRIPTION OF THE DRAWINGS

FIG. 5 shows a connecting structure in a state in which the contact according to the embodiment of the present invention is fitted to the opposite contact, in which

FIG. 6 is a drawing showing an example of the connector according to the embodiment of the present invention, in which

DESCRIPTION OF THE PREFERRED EMBODIMENT

Figure 1:
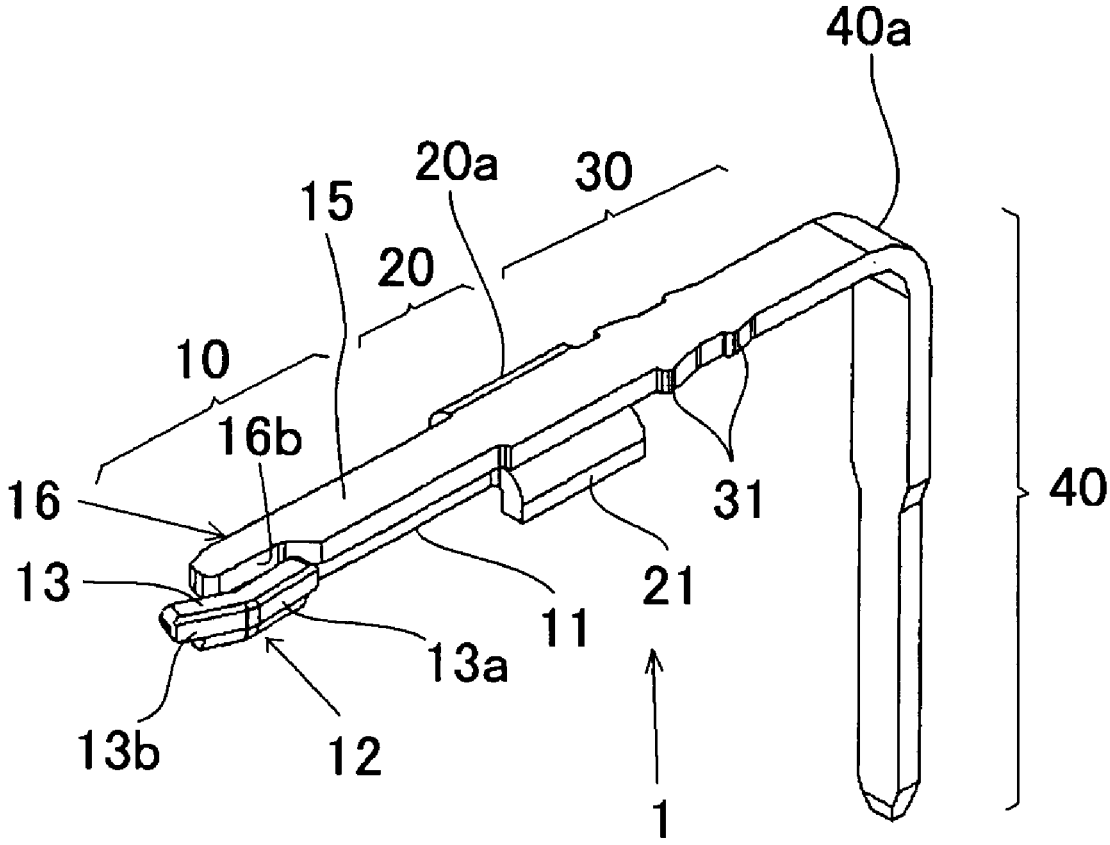
FIG. 1 is a perspective view of a contact according to an embodiment of the present invention viewed from the side of the distal end.
Figure 2:
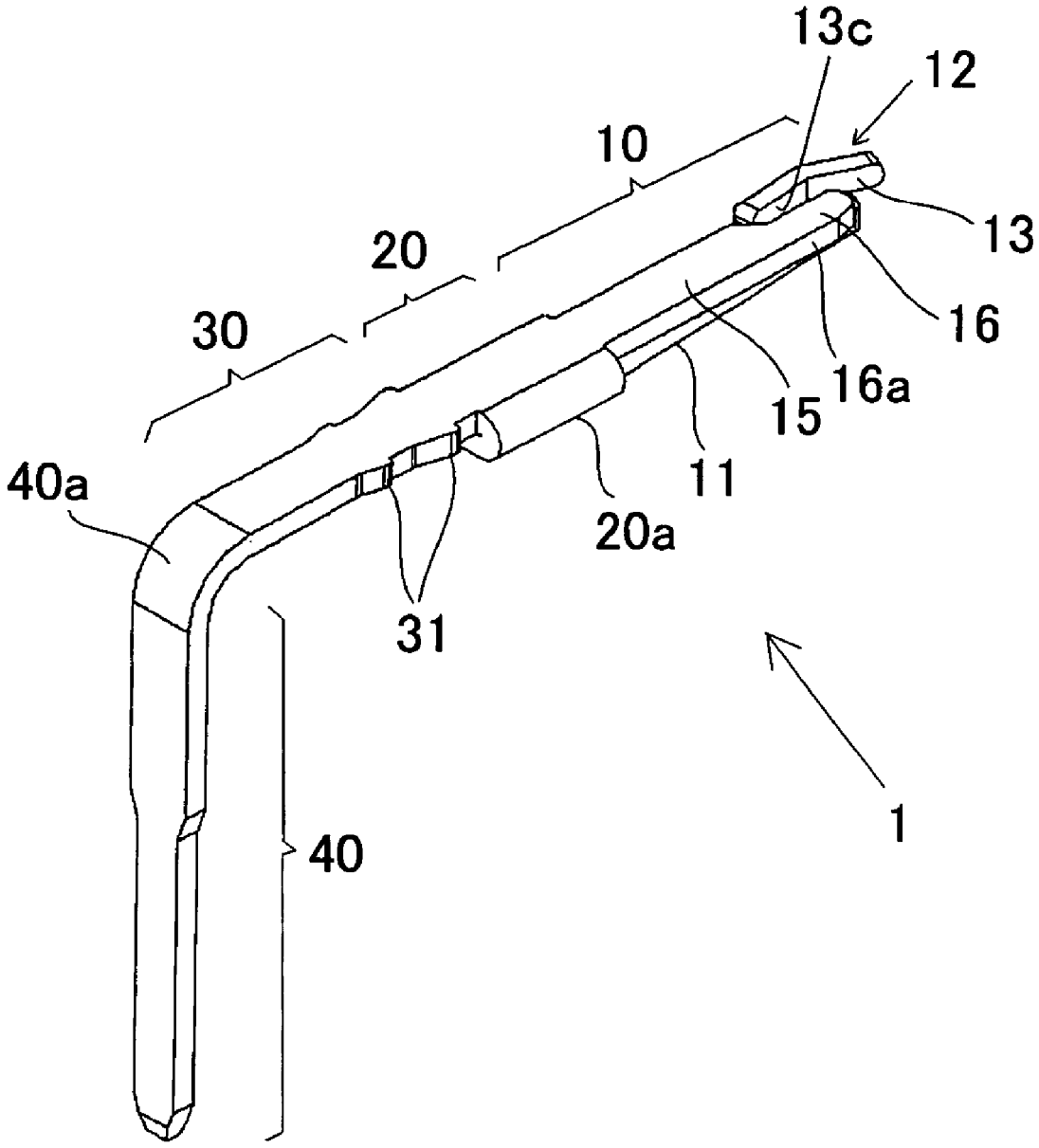
FIG. 2 is a perspective view of the contact according to the embodiment of the present invention viewed from the side of the rear end.
Figure 3:
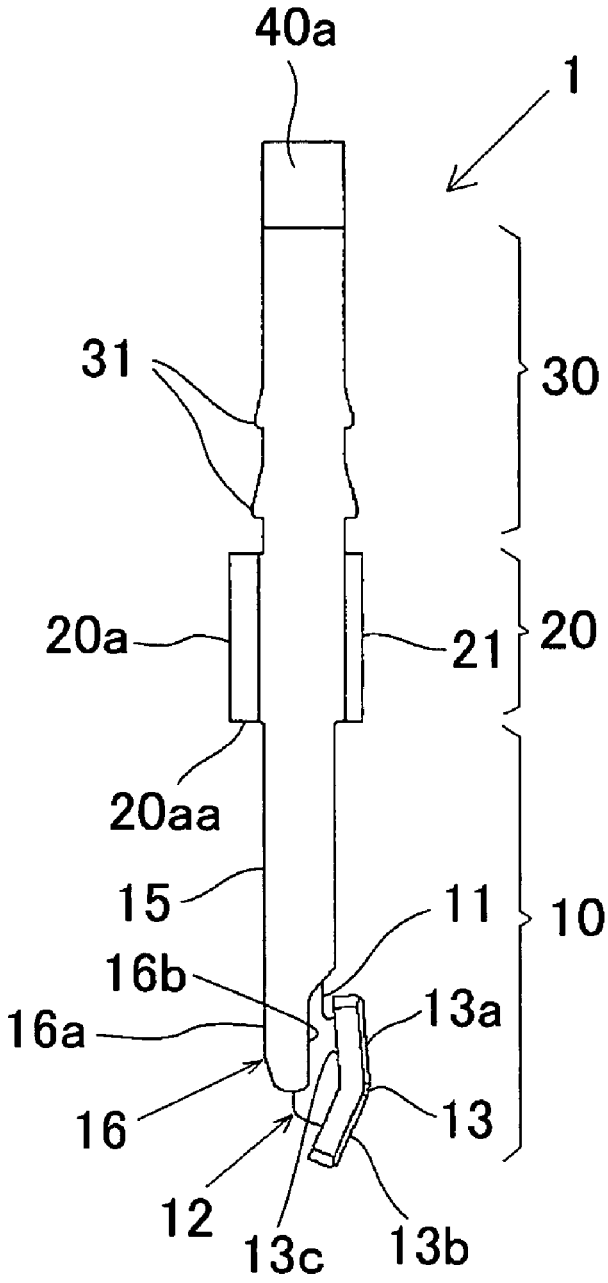
FIG. 3 is a top view of the contact according to the embodiment of the present invention.
Figure 4:
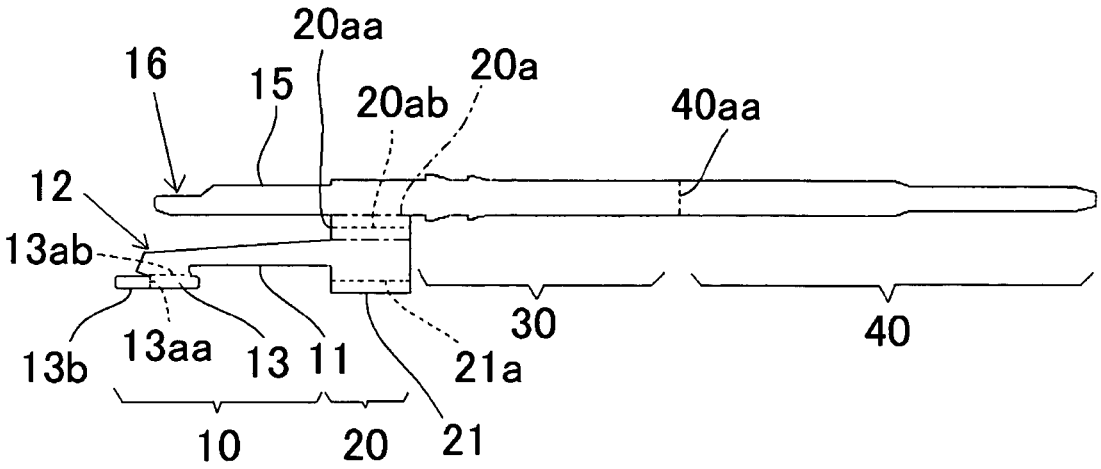
FIG. 4 is a deployed view of the contact according to the embodiment of the present invention.

Referring now to the drawings, an embodiment of the present invention will be described in detail. FIG. 1 to FIG. 4 show an example of a contact (male contact) according to the embodiment of the present invention. FIG. 1 is a perspective view of the contact according to the embodiment of the present invention viewed from the side of the distal end. FIG. 2 is a perspective view of the contact according to the embodiment of the present invention viewed from the side of the rear end. FIG. 3 is a top view of the contact according to the embodiment of the present invention. FIG. 4 is a deployed view of the contact according to the embodiment of the present invention. A contact 1 is formed into a substantially pin shape (thin band-plate shape), and is provided with a resilient contact section 10, a connecting section (bent portion) 20, a leading section 30, and a terminal section 40 from the distal end to the rear end.

The resilient contact section 10 includes a pair of extending sections in a band shape (thin band-plate shape) bifurcated toward the distal end. One of the extending sections serves as a second extending section 11 (or a movable strip), and the other extending section serves as a first extending section 15 (or a fixed strip). The second extending section 11 and the first extending section 15 are overlapped with each other so that the first extending section 15 placed on the upper side, that is, so that the lower surface of the first extending section 15 and the upper surface of the second extending section 11 mate each other. The first extending section 15 extends linearly toward the distal end in a substantially constant width and, at a first contact strip 16 as the distal section, one of the side edges is notched to reduce the width, and the other side edge is inwardly tapered. On the other hand, the second extending section 11 projects slightly forward from the distal end of the first extending section 15, and is formed into a tapered shape which is reduced in width gradually toward the distal end. A second contact strip 12 as the distal section of the second extending section 11 (hereinafter, referred simply to as the second contact strip 12) is enlarged at one side edge which corresponds to the notched side of the first contact strip 16 as the distal section of the first extending section 15 (hereinafter, referred simply to as the first contact strip 16) so as to increase the width thereof. Part of the portion increased in width is bent upward (toward the first contact strip 16), and a stopper member 13 of the second contact strip 12 opposing two-dimensionally to the first contact strip 16 is provided thereon. The stopper member 13 extends longitudinally along the first contact strip 16 which is the distal section of the first extending section 15, and includes a stopper surface 13*c* opposing to one of the side surfaces 16*b* of the first contact strip 16 at a predetermined distance. The distal end of the stopper member is directed inwardly, that is, bent in the horizontal direction at an obtuse angle so as to cover the front of the distal end of the first contact strip 16 to form an abutment preventing section 13*b* having one side surface tapered so as to project partly. The abutment preventing section 13*b* serves to allow the resilient contact section 10 to be inserted smoothly into the receiving section when the contact 1 is inserted into the receiving section of the opposite contact (female contact) from the distal end of the resilient contact section 10 to establish electrical connection. Also, it serves to prevent the distal end of the resilient contact section 10 (second contact strip 12) from being deformed by coming into abutment with the opening edge of the receiving section. The stopper member 13 of the second contact strip 12 is partly overlapped with the notched portion of the first contact strip 16, and is partly enlarged outwardly (toward the one of the side edges) from the notched portion. In this manner, the second contact strip 12 and the first contact strip 16 are disposed so as to be capable of relative movement in the horizontal direction by being shifted in the horizontal direction (widthwise direction). The pair of contact strips 12 and 16 are disposed at a predetermined distance from each other.

An outer surface 13*a* of the stopper member 13 at the second contact strip 12 and an outer surface 16*a* of the first contact strip 16, when being fitted to the receiving section of the opposite contact described later, come into press contact with the inner wall surface of the receiving section to achieve electrical connection.

The connecting section 20 is a portion connecting the second extending section 11 and the first extending section 15, which corresponds to the pair of contact strips, and includes a connecting strip 20*a* for connecting part of the other side surface of the first extending section 15 and the other side surface of the rear end section of the second extending section 11. In other words, the second extending section 11 and the first extending section 15 are connected at the rear end section via the connecting strip 20*a* between the side surfaces on the same side, and when a widthwise force is exerted so as to overlap the second contact strip 12 and the first contact strip 16 one on another (so as to reduce the predetermined distance between the second contact strip 12 and the first contact strip 16 to bring the second contact strip 12 and the first contact strip 16 closer to each other) via the connecting strip 20*a* (about the connecting strip 20*a*), the second contact strip 12 generates a spring resilient force to restore its original position. In this manner, the second extending section 11 and the first extending section 15 of the resilient contact section 10 can be displaced (moved) relatively in the widthwise direction by the connecting section 20. In other words, the second contact strip 12 serves as a movable end, and the portion connected to the connecting strip 20*a* at the rear end serves as a fixed end so that a spring resilient force is provided to the second extending section 11 by the contact 1 itself. The first extending section 15 is slightly enlarged in the widthwise direction at the other side edge at the connecting section 20 so as to increase in strength. On the other hand, the second extending section 11 is formed with an enlarged section 21 slightly enlarged from the other side edge at the connecting section 20, and the enlarged section 21 is bent downwardly and projects at the distal edge thereof slightly from the lower surface of the second extending section 11. The enlarged section 21 is configured in such a manner that, for example, when the contact 1 is held by being press-fitted into a through hole formed on the side wall of the connector housing so that the connecting section 20 is completely embedded, a guide groove is provided on the bottom surface of the through hole in the direction along the length thereof, so that the contact 1 can be press-fitted in a predetermined posture by inserting the enlarged section 21 along the guide groove. Also, by providing a slight gap between the lower surface of the second extending section 11 and the bottom surface of the through hole of the connector housing by the extending section 21, lowering of the spring resilient force at the distal section of the second extending section 11 due to friction caused by contact between the bottom surface of the second extending section 11 and the bottom surface of the through hole can be prevented or alleviated.

The leading section 30, being a portion to be located in the side wall of the connector housing when it is used as a connector (or a receptacle) by being held by the connector housing, is provided so as to continue from the connecting section 20 of the second extending section 11 and is extending linearly toward the rear end in a substantially constant width, and is formed with two each of hook-shaped projections 31 projecting horizontally from the both side surfaces, respectively. The four projections 31 are disposed so as to oppose to each other by two each. Accordingly, when the contact 1 is held by a connector housing described later and used as a connector, the contact 1 is prevented from being disconnected by these projections being located and embedded within the side walls of the connector housing, or being located at, and press-fitted into, the through holes provided on the side walls of the connector housing. When the contact 1 is not mounted to the connector and used by mounting on a printed board or the like by soldering or the like, the leading section 30 or the projections 31 are not necessary.

The terminal section 40 extends linearly from the leading section 30 toward the rear end at a substantially constant width and then bent downward by a substantially right angle at a bent portion 40*a*. The terminal section 40 is reduced in width from the midpoint of the portion which is bent and extending downward, and has a pointed rear end. The terminal section 40 is inserted into a through hole from the pointed portion at the rear end into a through hole formed on the printed board, and is joined by soldering.

Subsequently, a method of manufacturing the contact 1 will be described. FIG. 4 shows a deployed view of the contact 1. The contact 1 can be manufactured by punching a metal plate having substantially the same thickness, for example a copper plate or the like, into a predetermined shape, and bending the same. From the portion on the distal side which corresponds to the first extending section 15 to the portion which corresponds to the terminal section 40 is formed into a linear narrow shape. The first contact strip 16 being notched at one side edge and hence having a reduced width is formed at the distal end on the distal side as the first extending section 15, and the first extending section 15 being increased in width and extending from the first contact strip 16 toward the rear end is formed. Subsequently, the connecting section 20 enlarged from the other side edge in a substantially square shape is formed, and then the thin band-shaped portion which corresponds to the second extending section 11 is formed by being extending from substantially mid-section of the front end 20*aa* of the connecting section 20 toward the front in substantially parallel with the portion which corresponds to the first extending section 15. The portion with increased width, which corresponds to the second contact strip 12 is formed at the distal end of the portion which corresponds to the second extending section 11, and then the width is reduced from the portion with increased width of the second contact strip 12 at the distal end. Subsequently, one of the end edges is linearly extending to the connecting section, and the other end edge extends obliquely outward to the connecting section 20, so that the width is increased gradually (continuously) as a whole, and the second extending section 11 is connected to the center section (at the position apart from the first extending section 15 by a distance slightly larger than twice the thickness) of the front end 20*aa* of the connecting section 20. The portion which corresponds to the second extending section 11 is larger than the portion which corresponds to the first extending section 15, and the second contact strip 12 projects forwardly with respect to the first contact strip 16. The portion which corresponds to the second contact strip 12 is enlarged outward and hence increased in width, and then extending further at both ends (fore-and-aft direction of the contact 1) to form the portion which corresponds to the stopper member 13 into a elongated shape. The portion projecting toward the front from the midsection of the stopper member 13 is a portion which corresponds to the abutment preventing section 13*a*. In this manner, a pair of band-shaped strips, which correspond to the resilient contact section 10, are formed so as to project from the connecting section 20 in a fork shape.

On a straight line connecting the portion which corresponds to the first extending section 15 and the portion which corresponds to the terminal section 40, there are provided the portion which corresponds to the leading section 30, on which two each of projections 31 on both side edges respectively so as to oppose to each other at the position in the vicinity of the connecting section 20. Also, the portion which corresponds to the terminal section 40 extending rearward from the rear end of the leading section in substantially a constant width is reduced in width from the midpoint, and is formed into a pointed shape at the rear end.

With the metal plate punched in this shape, the abutment preventing section 13*b* at the distal end of the stopper member 13 of the second extending section 11 is bent first upward at the center of the stopper member 13 (a broken line 13*aa* in the drawing), then the stopper member 13 located outside the second contact strip 12 is bent along a broken line 13*ab* in the drawing so as to project upward, and simultaneously, or before or after that, the enlarged section 21 enlarged outward from the portion to which the second extending section 11 of the connecting section 20 is connected is bent along a broken line 21*a* in the drawing so as to project downward. Subsequently, it is folded at the center position (a broken line 20*ab* extending from the front end section 20*aa* in the drawing) of the portion connecting the first extending section 15 and the second extending section 11 of the connecting section 20, so as to overlap the second extending section 11 over the first extending section 15. Lastly, the portion on the side of the terminal section 40 is bent upward at the position between the leading section 30 and the terminal section 40 (a broken line 40*aa* in the drawing) to complete manufacturing of the contact 1.

Resilient deformation of the second extending section 11 which corresponds to the movable strip will now be described. In FIG. 3, when the contact 1 is inserted into an opposite contact 100, a corner overhung on the right side of the stopper member 13 of the first contact strip and the outer surface 16*a* of the first contact strip 16 are sandwiched between inner surfaces 101*a*, 101*b* of the both walls respectively and hence the distance between the both contact strips is reduced. In this case, resilient deformation thereby is considered to occur mainly at the portion of the first contact strip from the stopper member 13 to the connecting section 20. This resilient deformation may occur by a small extent but over the entire body, or may be concentrated to the portion having small deformation resistance (or spring constant). For example, the position where deformation is effected mainly may change depending on the depth of the notch near the intersection between the broken lines 13*aa* and 13*ab*. For example, when the notch is deeper than the extent represented by the broken line 13*aa*, the resilient deformation may be effected mainly at the position near the broken line 13*aa* which is a bent line. In contrast, when the notch is shallow, deformation to some extent is considered to occur on other portions (for example, the second extending section 11 or the connecting section 20) as well. These portions of deformations may be adjusted as needed according to the preferable feature of the contact 1.

The contact 1 described thus far is based on the embodiment in which it is used by inserting the terminal section 40 into the through hole for wiring of the printed board or the like, it may be used in an embodiment in which the terminal section 40 can be connected by being mounted on the surface of the conductive pad formed on the printed board or the like.

Figure 5A:
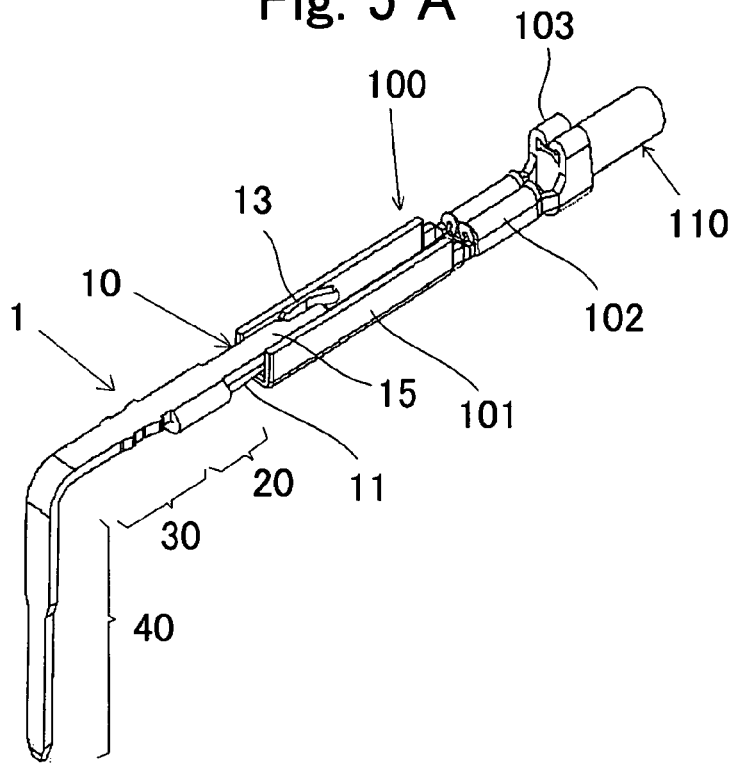
FIG. 5A is a perspective view.
Figure 5B:
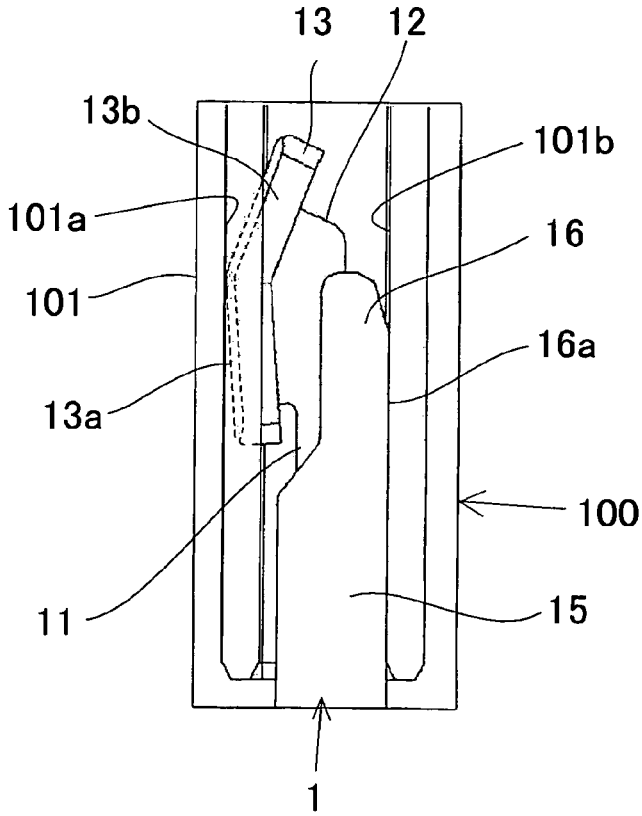
FIG. 5B is an enlarged view of the connecting section.

The contact 1 in this arrangement is inserted into the receiving section of the opposite contact from the distal end of the resilient contact section 10 on the distal side for establishing the electrical connection. FIG. 5 shows a connecting structure in a state in which the contact 1 is fitted into the opposite contact (female contact) 100, wherein FIG. 5A is a perspective view, FIG. 5B is an enlarged view of the connecting section. The opposite contact 100 includes a receiving section 101, a first contact-bonding section 102 to be connected to the receiving section 101 and a second contact-bonding section 103 to be connected to the first contact-bonding section 102. The receiving section 101 is formed into a square pipe shape (in the drawing, the receiving section 101 is shown without an upper wall for the convenience of illustrating the connecting relation with respect to the contact 1), and the first contact-bonding section 102 is contact-bonded and electrically connected with a core wire exposed at the distal end of the electric able 110, the second contact-bonding section 103 is contact-bonded with the distal end of the outer covering tube of the electric cable 110 to fix the electric cable 110, so that the electric cable 110 does not come apart. Although the receiving section 101 is formed into the square pipe in FIG. 5, it may be a pipe shape such as a cylindrical shape. The shape of the receiving section 101 is not specifically limited as long as it has an inner wall surface to which the outside surface 13*a* of the stopper 13 of the second contact strip 12 and the outside surface 16*a* of the first contact strip 16 come into abutment by the spring resilient force of the second extending section 11.

Then, the resilient contact section 10 of the contact 1 is inserted into the receiving section 101 of the opposite contact 100. The outside surface 13*a* of the stopper member 13 comes into abutment with a left inner wall surface 101*a* of the receiving section 101 by the spring resilient force of the second extending section 11. On the other hand, the outside surface 16*a* of the first contact strip 16 comes into abutment with a right inner wall surface 101*b*, so that the contact 1 and the opposite contact 100 are electrically connected.

The both inner walls 101*a*, 101*b* of the receiving section 101 are isolated by a predetermined distance. The distance is preferably equal to or slightly smaller than the width of the first and second contact strips 16, 12 of the contact 1 (the lateral length in FIG. 5B) in a free state. More preferably, it is larger than the width obtained when it is clamped to an extent that the distance between the first and second contact strips 16, 12 becomes zero.

Figure 6A:
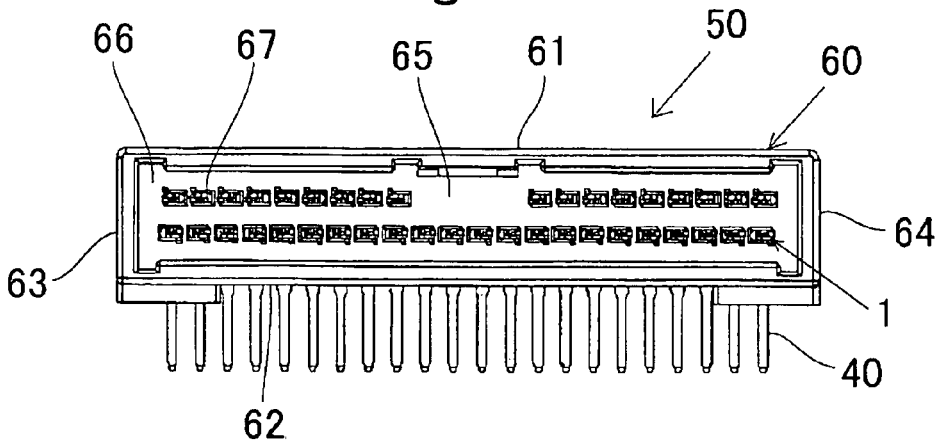
FIG. 6A is a front view of the connector.
Figure 6B:
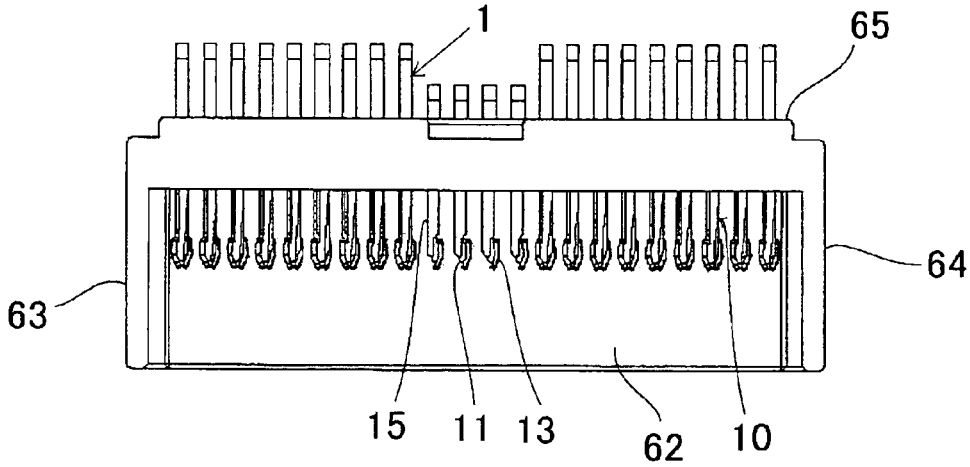
FIG. 6B is a plan view of the connector with the upper wall omitted.
Figure 6C:
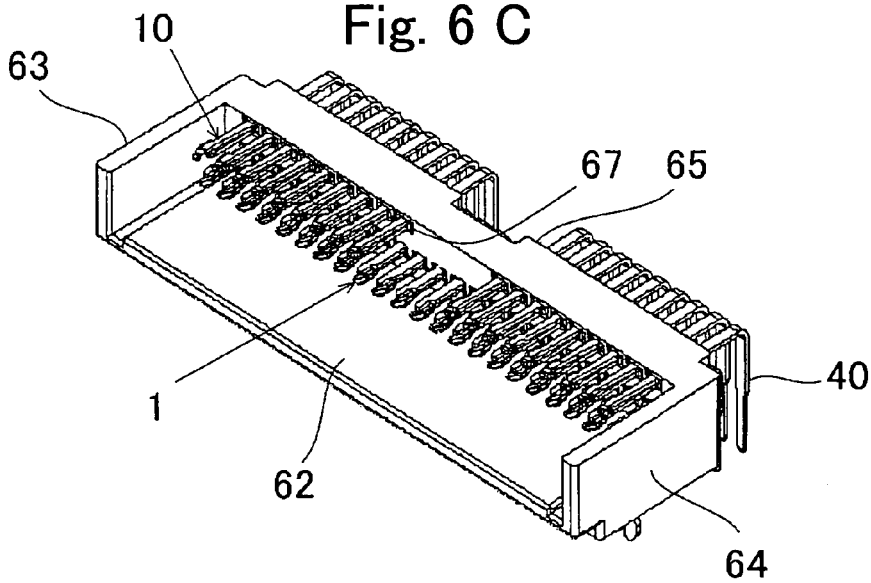
FIG. 6C is a perspective view of the connector with the upper wall omitted.

Subsequently, a connector (receptacle) using the contact 1 will be described. FIG. 6 shows an example of the connector according to the embodiment of the present invention. FIG. 6A is a front view of the connector, FIG. 6B is a plan view of the connector with the upper wall omitted, and FIG. 6C is a perspective view with the upper wall of the connector omitted. A connector 50 includes a plurality of contacts 1 and a connector housing 60 for retaining the plurality of contacts 1.

The connector housing 60 is formed of synthetic resin mold having a substantially parallel piped box-shape, and is provided with an opening 66 surrounded by an upper wall 61, a lower wall 62, both side walls 63, 64, and a rear wall 65 and opened in front. The rear wall 65 is provided with a plurality of substantially square shaped through holes 67 connecting the inside and the outside of the connector housing 60 and being arranged in two rows and two columns at predetermined intervals.

The contact 1 is press-fitted into and held by each through hole 67 of the connector housing 60. The contacts 1 are positioned in such a manner that parts of the rear sides of the connecting sections 20 (see FIG. 1) or part of the front sides of the leading sections 30 are located in the through holes 67 on the rear wall 65 of the connector housing 60. Also, parts of the front sides of the resilient contact sections 10 and the connecting sections 20 are disposed within the housing. Furthermore, parts of the leading section 30 on the rear side and the terminal sections 40 are disposed so as to project from the outer wall surface of the rear wall 65 and retained by the connector housing 60. It is also possible to dispose the connecting sections 20 entirely or only partly in the through holes 67 of the connector housing 60 to be retained, or to dispose the leading sections 30 entirely or only partly within the through holes 67 to be retained.

The resilient contact sections 10 of the contacts 1 are held in such a manner that the distal ends thereof are retained so as to project from the rear wall 65 (through holes 67) until the midpoint of the interior of the connector housing 60, and disposed so that the first extending sections 15 are positioned on the upper sides and the second extending sections 11 are positioned on the lower sides. On the other hand, the terminal sections 40 of the contacts 1 are extending to the rear side of the rear wall 65 of the connector housing 60 and bent downward.

In FIG. 6, the connector 50 is formed with through holes 67 penetrating through the rear wall 65 of the connector housing 60, and retains the contacts 1 in the through holes 67 being press-fitted therein. However, it is also possible to manufacture the connector integrally by resin-molding the connector housing by injection molding in a state in which the plurality of contacts 1 are disposed in a suitable metal mold, so that the contacts 1 are embedded within the connector housing. In this manner, when allowing the connector housing to embed and retain the contacts 1 integrally therewith, it is preferable to position the parts other than the front end portions 20*aa* of the connecting sections 20 and/or the leading sections 30 of the contacts 1 within the side wall of the connector housing so that the connecting sections 20 or the front end portions 20*aa* of the connecting sections 20 project into the interior of the connector housing 60 in order to prevent the spring resilient force of the second extending section 11 of the contacts 1 from lowering even when synthetic resin forming the connector housing is deteriorated by thermal cycling due to the duration of service.

As described thus far, the contact 1 according to the present invention includes the resilient contact section 10 formed by overlapping a pair of thin band-shaped extending sections (second extending section 11 and the first extending section 15) overlapped with each other so that the pair of contact strips at the distal ends of the extending sections disposed slightly apart from each other, and adapted in such a manner that when the distal portions of the pair of contact strips are pressed from the outside toward each other when the resilient contact section 10 is inserted into the receiving section 101 of the opposite contact 100, the spring resilient force of the pair of contact strips to restore their original position is generated as a reaction, and the outer side walls (outside surfaces) of the distal portions of the pair of contact strips press the inner wall surfaces of the receiving section 101 of the opposite contact 100 to establish electrical connection. Therefore, the mounting height of the contact 1 may be reduced to double the thickness of the metal plate constituting the contact 1. Consequently, when the connector 50 is used with the contacts 1 retained in the connector housing 60, the height of the connector 50 (connector housing 60) can be reduced obviously, whereby an ultra thin male connector is provided.

Figure 7:
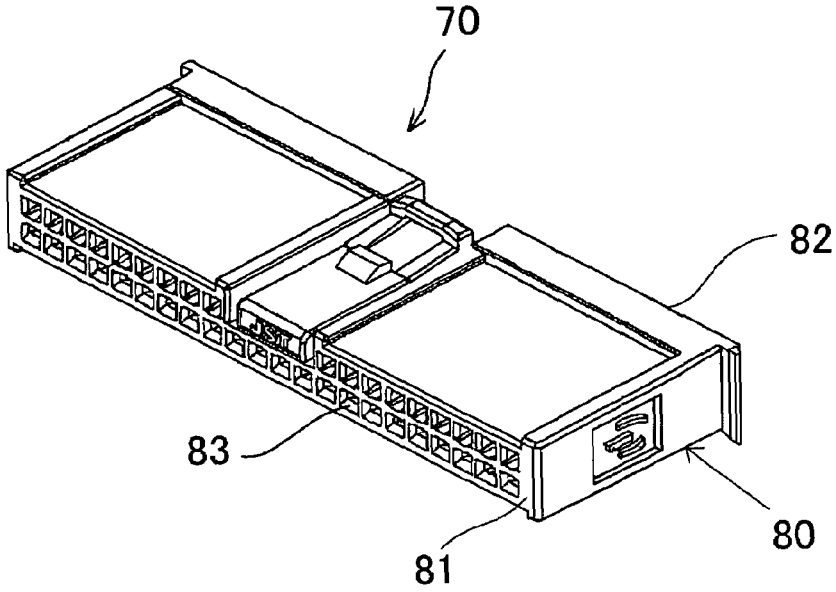
FIG. 7 is a perspective appearance view of the opposite connector to be fitted to the connector according to the embodiment of the present invention.

Subsequently, an opposite connector (plug) to be mounted to the connector 50 configured as shown above will be described. FIG. 7 is a perspective appearance view of the connector according to the embodiment of the present invention and the opposite connector to be mounted thereto. In FIG. 7, the opposite contact 100 and the electric cable 110 contact-bonded to the opposite contact 100 are omitted. The connector 70 includes a connector housing 80 and the opposite contact 100 (see FIG. 5) to be retained in the connector housing 80. The electric cable 110 is connected to the opposite contact 100. The connector housing 80 includes a synthetic resin mold of substantially parallelepiped shaped and is formed with a plurality of through holes 83 penetrating from a front surface 81 to a rear surface 82 arranged in two rows and two columns (honey-comb state) at predetermined intervals. The opposite contact 100 including the electric cable 110 connected from the side of the rear surface 82 is inserted into each of the plurality of through holes 83, and the opposite contact 100 is retained by the connector housing 80. In FIG. 7, the opposite contacts 100 are completely received and retained in the through holes 83 so that the distal ends of the receiving sections 101 of the opposite contact 100 are located at positions slightly recessed from the front surface 81 of the connector housing 80 toward the rear surface 82, and the second contact-bonded portions 103 of the opposite contacts 100 are located at the positions recessed from the rear surface 82 of the connector housing 80 slightly toward the front surface 81.

Figure 8:
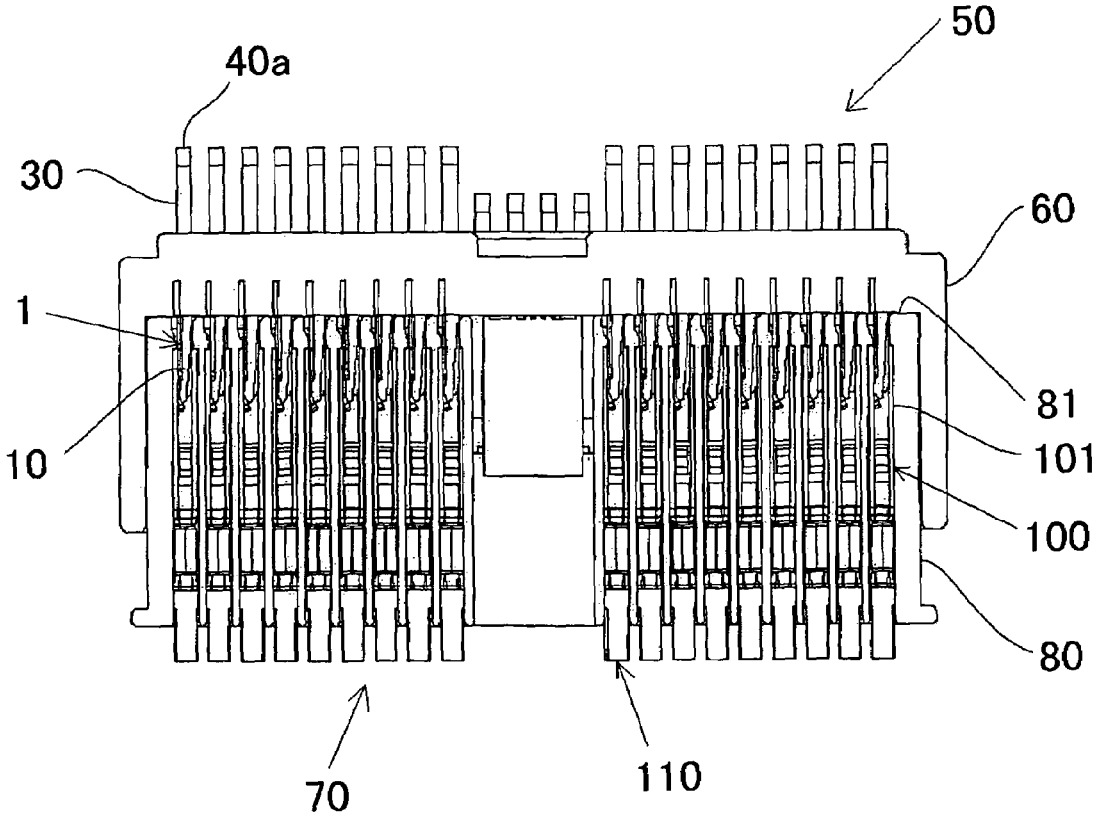
FIG. 8 is a lateral cross-sectional view for explaining the state in which the connector according to the embodiment of the present invention is fitted to the opposite connector.

FIG. 8 is a lateral cross-sectional view for explaining a state in which the connectors according to the embodiment of the present invention are mounted to the opposite connectors (plug). In FIG. 8, the opposite connectors 70 are inserted into the openings 66 of the connector housing 60 of the connector 50 from the side of the front surface 81 of the connector housing 80. The opposite connectors 70 is mounted to the connector 50 with the front surface 81 of the connector housing 80 abutted against the inner wall surface of the rear wall 65 of the connector housing 60 of the connector 50. Each contact 1 is inserted into the receiving section 101 of the corresponding opposite contact 100. The opposite contacts 100 are retained in the through holes 83 of the connector housing 80 of the opposite connector 70. The resilient contact sections 10 of the contacts 1 come into abutment with the left and right inner wall surfaces 101*a*, 101*b* of the receiving sections 101 of the opposite contacts 100, so that electrical connection is established between the contacts 1 and the opposite contacts 100.

Since the opposite connector 70 described thus far has a size relative to the connector 50 described above, an ultra thin connector (plug) is provided.

The present invention can be utilized as a contact or a connector for connecting electric signals to a printed board to be stored in various types of electronic equipment, and contributes to reduction of size, more specifically to reduction of thickness of such electronic equipment.

What is claimed is:

1. A contact to be inserted between opposed two walls, at least one of these walls being an opposite contact, for establishing electrical connection with the opposite contact, comprising:

a connecting section;

a first extending section extending from the connecting section toward a distal end thereof in a band-shape along a direction of insertion thereof;

a first contact strip positioned in a vicinity of the distal end of the first extending section and connected to the first extending section;

a second contact strip disposed at a predetermined distance from the first contact strip so as to oppose thereto; and a band-shaped second extending section extending from the second contact strip to the connecting section; the second extending section being disposed so that a face of the band-shape of the second extending section overlaps a face of the band-shape of the first extending section, wherein the second contact strip being mechanically connected to the first contact strip via the second extending section, the connecting section, and the first extending section, and wherein at least part of the portion between the second contact strip and the connecting section is resiliently deformed when the distance between the first contact strip and the second contact strip is reduced.

2. The contact according to claim 1, wherein the second contact strip is a movable strip and the first contact strip is a fixed strip.

3. The contact according to claim 1, wherein the second extending section is formed so as to be reduced in thickness of the band shape stepwise or continuously toward the distal end.

4. The contact according to claim 1, wherein the second extending section is formed so as to be reduced in width of the band shape stepwise or continuously toward the distal end.

5. A connector retaining the contact according to claim 1 in a connector housing.

6. The contact according to claim 2, wherein the movable strip is bent from the second extending section substantially by an approximately right angle and constitutes a stopper member, and wherein the stopper member is bent toward the fixed strip so that a distal end of the stopper member comes into abutment with the fixed strip.

7. The contact according to claim 2, wherein the movable strip extends beyond the distal end of the fixed strip, and comprises an abutment preventing section being bent toward the fixed strip.

8. The contact according to claim 6, wherein the second extending section is formed so as to be reduced in thickness of the band shape stepwise or continuously toward the distal end.

9. The contact according to claim 7, wherein the second extending section is formed so as to be reduced in thickness of the band shape stepwise or continuously toward the distal end.

10. The contact according to claim 6, wherein the second extending section is formed so as to be reduced in width of the band shape stepwise or continuously toward the distal end.

11. The contact according to claim 7, wherein the second extending section is formed so as to be reduced in width of the band shape stepwise or continuously toward the distal end.

12. A connector retaining the contact according to claim 6 in a connector housing.

13. A connector retaining the contact according to claim 7 in a connector housing.

14. A connector retaining the contact according to claim 3 in a connector housing.

15. A connector retaining the contact according to claim 4 in a connector housing.

16. The connector according to claim 5 wherein the distal end of the connecting section between the first and second contact strips of the contact is not retained within the connector housing.

* * * * *